United States Patent [19]

Grassner

[11] Patent Number: 4,589,589

[45] Date of Patent: May 20, 1986

[54] FOLDING BOX BLANK

[75] Inventor: Willi Grassner, Langenfeld, Fed. Rep. of Germany

[73] Assignee: Henkel Kommanditgesellschaft auf Aktien, Duesseldorf, Fed. Rep. of Germany

[21] Appl. No.: 622,418

[22] Filed: Jun. 20, 1984

[30] Foreign Application Priority Data

Jun. 22, 1983 [DE] Fed. Rep. of Germany ..... 3322438

[51] Int. Cl.[4] ..... B65D 5/46; B65D 5/28

[52] U.S. Cl. ..... 229/52 B; 229/134; 206/626

[58] Field of Search ..... 229/52 B, 37 R, 38; 206/621–634

[56] References Cited

U.S. PATENT DOCUMENTS

| | | | |
|---|---|---|---|
| 2,693,310 | 11/1954 | Stopper | 229/52 B |
| 3,361,328 | 1/1968 | Buttery | 229/37 R |
| 3,521,741 | 7/1970 | Beaudry | 229/52 B |
| 4,017,017 | 4/1977 | Vos | 229/38 |
| 4,412,619 | 11/1983 | Van Laer | 229/52 B X |

FOREIGN PATENT DOCUMENTS

| | | | |
|---|---|---|---|
| 2845720 | 4/1980 | Fed. Rep. of Germany | 229/DIG. 9 |
| 8210781 | 10/1983 | Fed. Rep. of Germany . | |
| 2446232 | 9/1980 | France | 229/37 R |
| 601064 | 6/1978 | Switzerland | 229/52 B |

*Primary Examiner*—George E. Lowrance
*Assistant Examiner*—Bryon Gehman
*Attorney, Agent, or Firm*—Ernest G. Szoke; Henry E. Millson, Jr.; Mark A. Greenfield

[57] ABSTRACT

A folding box blank, and a box assembled therefrom, having an integral carrying handle flap comprised of three segments with a griphole means passing through two of the segments. Relief embossings are located on all four side wall flaps and pairs of complementary cutouts are located on one of the upper and one of the lower remaining wall flaps, so that when the box is assembled the cutouts interact with the embossing by biasing against them.

18 Claims, 13 Drawing Figures

FIG. 1
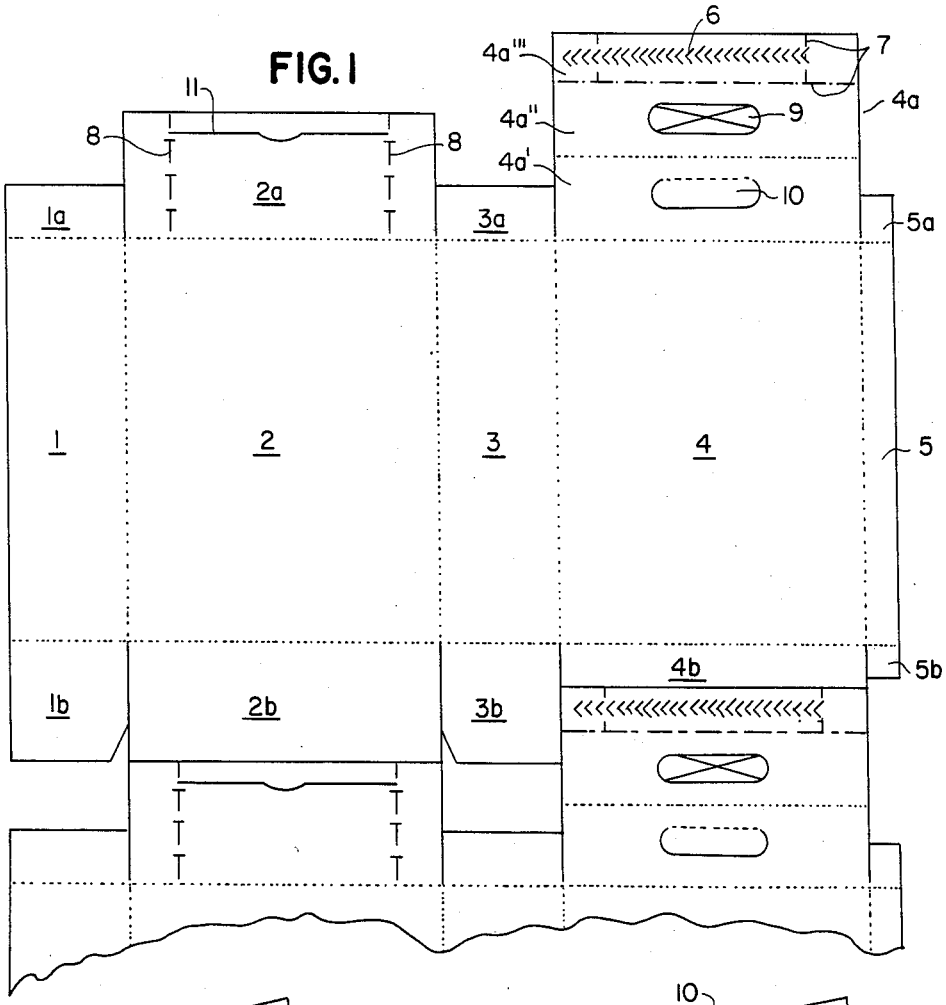
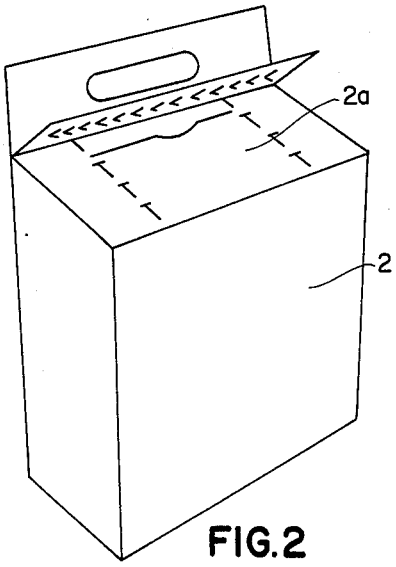
FIG. 2
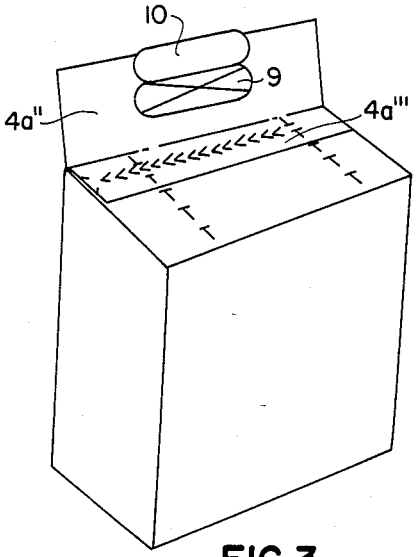
FIG. 3

FIG. 4
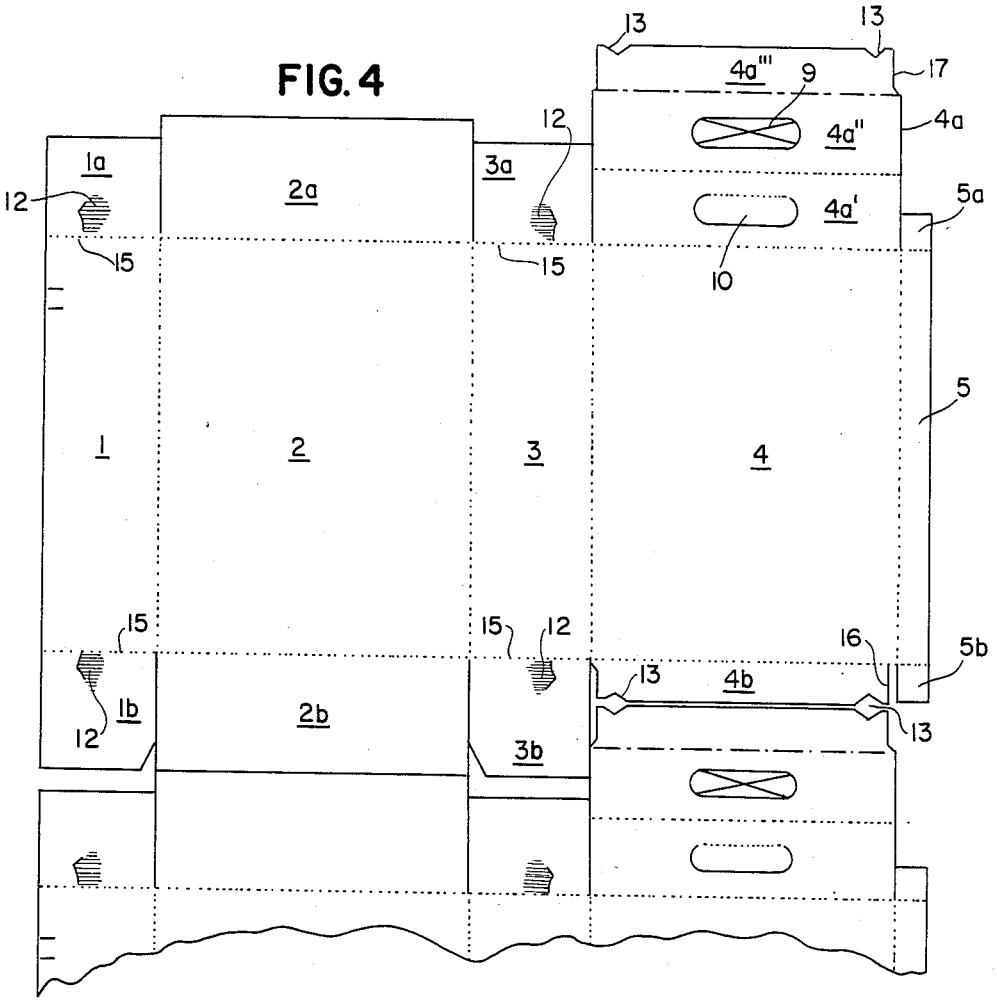
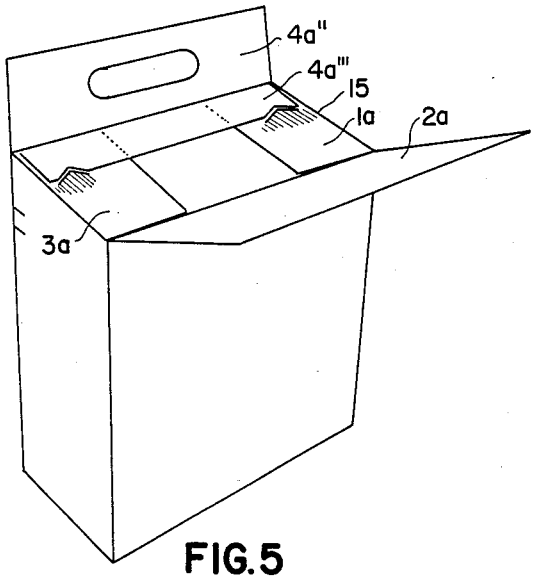
FIG. 5
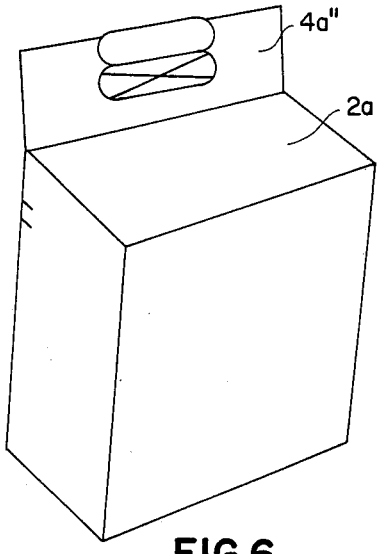
FIG. 6

FOLDING BOX BLANK

BACKGROUND OF THE INVENTION

1. Field of the Invention

This invention relates to a blank for a folding box having integral carrying means.

2. Statement of the Prior Art

Boxes with carrying handles are known, although such handles are frequently formed of a different material from the box itself, usually a plastic handle and a paper box. Known integral carrying handles of conventional folding boxes require an extra material consumption of around 25% in the case of single blank panels and around 13% in the case of double or multiple blank panels. As a result, such integral handles cannot compete economically with plastic handles.

German patent application No. 28 45 720, which has the same inventor as the present invention, discloses a known integral handle folding box. To save material when working from a reel, one of the wall (i.e. non-side) flaps of the blank described in this prior art is alternately shortened on top and underneath. The blank can be folded into a powder-tight folding box, on which one wall flap is shortened by a fairly considerable amount, for example to one third, in a staggered arrangement. A tear open perforation may even be provided in the shortened wall flap. In an alternative embodiment, the prior art folding box blank may also be designed in such a way that the assembled and glued box shows undivided top and bottom surfaces, by gluing the unshortened wall flap as an outer flap onto the other side and other wall flaps.

In addition, German Utility Model No. 82/10,781 describes a box blank in which the wall flaps are shortened to approximately two thirds of the depth of the assembled box both on top and underneath. The corresponding assembled box has divided top and bottom surfaces.

A box produced from the blank according to German patent application No. 28 45 720 can be made powder-tight by relief embossings and cutouts corresponding to the relief embossings. The relief embossings and corresponding cutouts may be provided either on the side flaps or on the wall flaps, depending on the folding and gluing sequence of the side flaps with the shortened wall flaps.

If desired, the known folding box may be provided with a carrying handle in the form of a strip of plastic fixed in the side walls by rivets or the like.

SUMMARY OF THE INVENTION

This invention provides a box blank with top and bottom surfaces comprising wall and side flaps hinged via fold lines to the front, back, and side walls of the box, one of the wall flaps having the same height as the width of the side walls and the other, associated wall flap, being shortened to between about one third and one quarter of that width. As used herein, "width" will refer to the lateral dimensions (e.g. from left to right in the figures), "height" or "length" will refer to the vertical dimensions (e.g. from top to bottom in the figures) and "depth" will refer to the depth of an assembled box, which will be the same as the width of the side walls in the figures.

Moreover, the present invention provides a box blank with an integral carrying means which, in contrast to conventional box blanks without an integral carrying means, does not necessitate any extra consumption of material. In addition, the folding box blank according to the invention is designed in such a way that the box to be assembled therefrom does not differ externally from standard boxes and may be glued in a powder-tight manner. This is achieved in accordance with the invention in that a shortened wall flap is hinged to its associated wall via an integral carrying means and in that the carrying means comprises two strips which are intended to be folded together and which are joined by fold lines to the adjoining wall on the one hand and to a shortened flap on the other hand. When the strips are folded together, the carrying means panel forms a carrying handle in the form of a griphole, substantially at its center.

According to the present invention, in contrast to the prior art, it is possible to produce a box blank without any additional consumption of carton material by combining the known, shortened wall flap with an integrated carrying handle. In the box blank designed in accordance with this invention, therefore, an integral carrying handle may be provided at no extra cost. Compared with prior art box blanks with integrated carrying handles, not only is a considerable saving of material achieved, but also the load bearing strength of the handle is improved through shifting of the preferential carton fiber direction towards the top of the parcel.

In principle, the box blank according to the invention may assume various embodiments. In a first group of embodiments, the flaps facing the shortened wall flap at the top and bottom of the parcel remain whole. In one case, the shortened flap contains a tear-open perforation and is glued as an outer flap. Although, in that case, the top and bottom surfaces are laterally divided, this solution—in combination with the tear-open perforation over a tear-open thread on the shortened flap hinged to the carrying handle—is practical and provides for optimal product visibility. In the other case of the first group, the top and bottom surfaces of the box are undivided, provided that the unshortened wall flaps at the top and bottom are glued as outer flaps. In that case, there is no difference from conventional boxes.

In another group of embodiments of the box blank, either the top and bottom surfaces are laterally divided or only the bottom surfaces are divided (the top surfaces remaining undivided) and the carrying handle integrated in such a way that the blanks can be economically produced from sheet. In a first case, all the flaps are reduced to approximately two thirds of the depth of the parcel and the opening for the carrying handle is located between a wall flap in the form of a gluing strip on the cover and the wall. In the other case, only flaps associated with the bottom of the box are shortened to two thirds of the depth of the box, although the flaps associated with the top of the box are dimensioned in the same way as in the first group of embodiments.

BRIEF DESCRIPTION OF THE DRAWINGS

Embodiments of the invention are described in detail in the following with reference to the accompanying drawings, wherein:

FIG. 1 shows a box blank with a tear-open perforation on its top.

FIG. 2 shows the same blank in the course of gluing.

FIG. 3 shows the completely assembled box of FIG. 1.

FIG. 4 shows a box blank with sealing details, embossed zones on the side flaps and cutouts in the shortened wall flaps.

FIG. 5 shows the same blank in the course of gluing.

FIG. 6 shows the completely assembled box of FIG. 4.

DETAILED DESCRIPTION OF THE INVENTION

Figure 7:
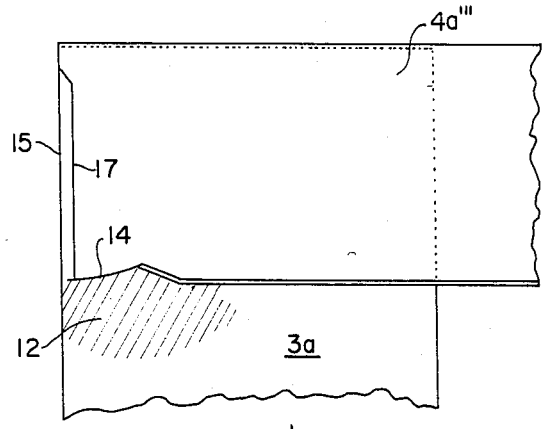
FIGS. 7 to 9 show optimized sealing details which guarantee powder-tight gluing, even when the gluing of the flaps is heavily staggered, FIG. 7 being at the top of the box and FIG. 8 at the bottom.

The blanks shown in FIG. 1 and the box assembled therefrom as shown in FIGS. 2 and 3 comprise: the first side wall 1, with its corresponding upper first side flap 1*a* and lower first side flap 1*b;* the front wall 2, with its corresponding upper front wall flap 2*a* and lower front wall flap 2*b;* the second side wall 3, with its corresponding upper second side flap 3*a* and lower second side flap 3*b;* the back wall 4, with its corresponding upper back wall flap which forms an integral carrying handle flap 4*a* and lower back wall flap 4*b;* and a narrow gluing strip 5, with its upper gluing strip flap 5*a* and lower gluing strip flap 5*b*. Side walls 1, 3 should be of equal dimensions, as should front wall 2 and back wall 4.

Figure 10:
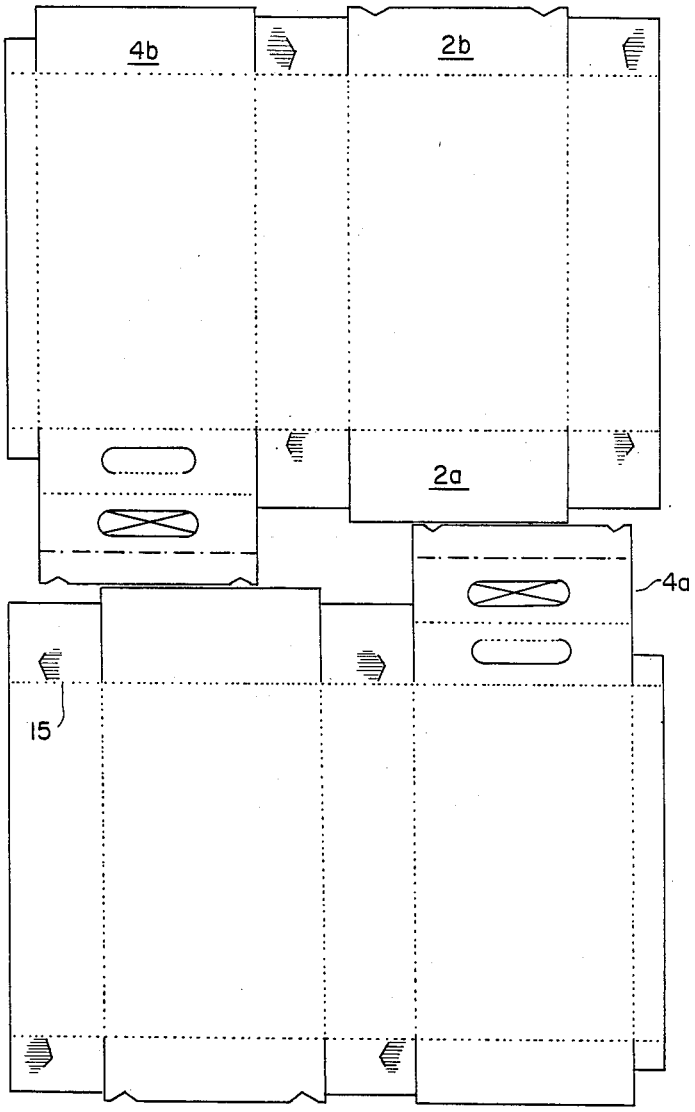
FIG. 10 shows shows a double blank with a laterally divided bottom surface, but an uninterrupted top surface.
Figure 11:
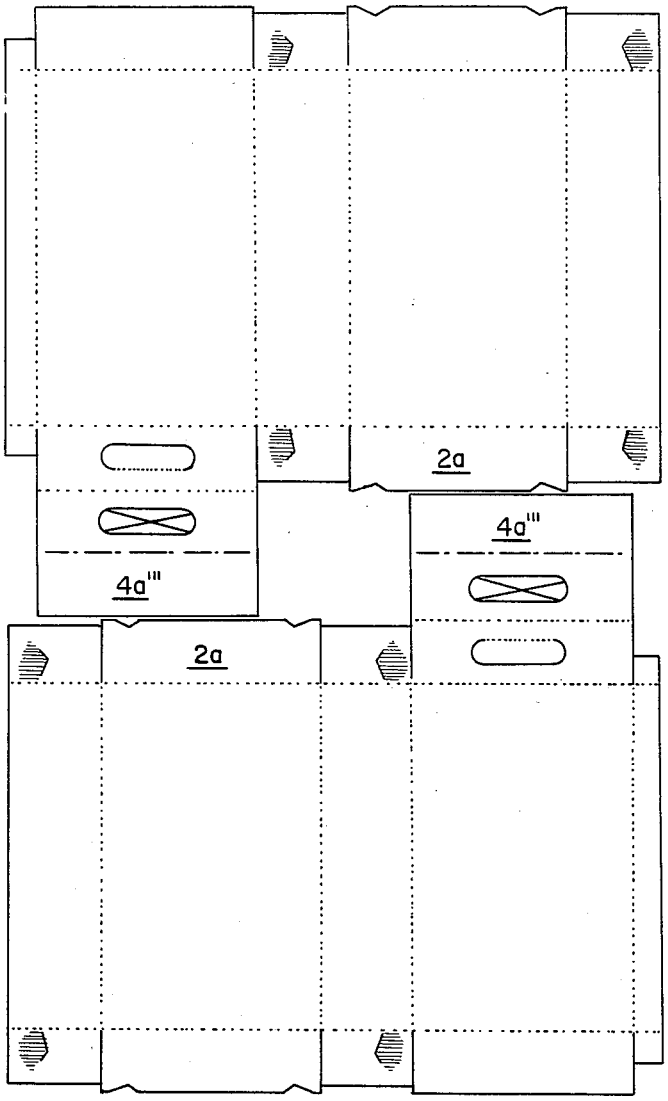
FIG. 11 shows a double blank in which both the bottom and top surfaces are laterally divided.

The foregoing components form the basic box blank as shown in all figures of this invention, various embodiments being afforded by varying the different upper and/or lower flaps and the carrying handle flap 4*a*. For clarity of description, the box blank should be visualized as if the walls and flaps were folded toward the viewer, so that the surfaces shown would be on the inside. It should be obvious that the box blank may, in actuality, be folded in either direction. The fold lines are all shown as dotted lines without element identification numbers. FIGS. 1, 4, 10, and 11, all show two box blanks joined to each other, as they might be during production, before separation. Thus, in FIGS. 1 and 4, the bottom edge of lower front wall flap 2*b* abuts the top edge of the succeeding upper front wall flap 2*a*, and in like manner, the bottom edge of lower back wall flap 4*b* abuts the top edge of the succeeding carrying handle flap 4*a*. FIGS. 10 and 11 depict a production variation in which abutting box blanks are reversed, thus, the top edge of each carrying handle 4*a* abuts the top edge of each upper front wall flap 2*a*.

In the embodiment shown in FIG. 1, it should be noted that both upper side flaps 1*a*, 3*a* are identical in configuration and are substantially shorter than upper front wall flap 2*a*, which lies between them. It should also be noted that lower back wall flap 4*b* is substantially shorter than lower front wall flap 2*b*. Conveniently, the combined length of flaps 2*a* and 2*b* should exactly equal the combined length of carrying handle 4*a* and flap 4*b*, so that box blanks may be produced with minimum material waste. Adjustments to this combined length are preferably made by shortening lower back wall flap 4*b* and/or handle outer segment 4*a'''*, rather than the other handle segments 4*a'*, 4*a''*. Lower side flaps 1*b* and 3*b* may be of identical configuration, or may have mirror-image chamfers on opposite free corners. The length of lower side flaps 1*b*, 3*b* is preferably the same as the length of lower front wall flap 2*b*, which should be approximately equal to the width of the side walls. The upper front wall flap 2*a* in the embodiment of FIGS. 1–3 is long enough substantially to cover the top of the assembled box, as shown in FIG. 2. In practice, because of the carrying handle flap 4*a*, it may be desirable for the upper front wall flap 2*a* to be slightly shorter than the width of side walls 1, 3. In this embodiment, flap 2*a* also has two lines of auxiliary flap perforations 8, each spaced a short distance from the opposite longitudinal flap edges, and preferably parallel. Additionally, upper front wall flap 2*a* has an incision 11 that is parallel to its upper edge and which is placed so that it is below handle outer segment 4*a'''* when the box is assembled (see FIGS. 2 and 3). Incision 11 extends completely between the two rows of auxiliary flap perforations 8. Preferably, the center of incision 11 is modified by a short arc curved away from the flap upper edge. The purpose of incision 11 will be explained below.

The integral carrying handle flap is comprised of three parallel strip segments. The handle inner segment 4*a'* is an extension of the back panel 4, is demarked by a fold line, and has a griphole flap 10 in its center. The griphole flap 10 is depicted as an elongated oval, one side of which is a fold line and the remaining circumference of which is a cut completely through the blank material. The exact configuration of the griphole is not critical, and may be a circle, rectangle, etc., although a configuration without easily-tearable sharp angles is preferred. The handle middle segment 4*a''* has the same dimensions as the handle inner segment 4*a'*, and has a punch-out cut griphole 9 which is of similar configuration and placement to the griphole flap 10. The height of segments 4*a'* and 4*a''* may vary, but should be between about 0.4 and 0.8 times, preferably about 0.6 and 0.8 times, especially about 0.65 and 0.75 times, the width of the side panels. The handle outer segment 4*a'''* is a further extension of the handle middle segment 4*a''*, but is demarked therefrom by an auxiliary handle perforation 7. Further auxiliary handle perforations 7 extend upward at right angles and are placed in a similar manner to the auxiliary flap perforations 8 in the upper front wall flap 2*a*. Lastly, a tear-strip 6 is provided on handle outer segment 4*a'''*, which tear-strip extends from one end laterally across to the farther right-angle auxiliary handle perforation 7. The tear-strip 7 is placed so that when the box is completely assembled, as shown in FIG. 3, the tear-strip 7 is directly over the incision 11.

The integral carrying handle flap 4*a* is folded during assembly of the box, so as to form a carrying handle of double thickness (elements *a'* and 4*a''*) which is integral with back wall 4 at one end and fastened to the top of the box by gluing handle outer segment 4*a'''* across the top, as shown in FIGS. 2 (before gluing) and 3 (after gluing). In the embodiment of FIGS. 1 to 3, the tear strip 6 of flap segment 4*a'''* is located above incision 11. In the folded handle, griphole 9 and griphole flap 10 are aligned, and slight pressure on the griphole flap 10 side wall pop out the material in griphole 9 (if any) and fold the griphole flap 10 through the griphole 9, forming a completed carrying handle.

To open the box, tear strip 6 is torn exposing incision 11. A finger or other object is then pressed against incision 11 (preferably at the arc), and that portion of the upper front wall flap 2*a* defined by incision 11 and perforations 8 is pulled out so as to tear the perforations and form a closeable box opening. From this description of the manner of use, it should be apparent that the length of the handle outer segment 4a''' should be short enough so that it will not obstruct the opening of the box, but long enough to support the tear strip 6 and to strengthen the joint of the carrying handle to the rest of the box. Preferably flap segment 4a''' should be about 0.25 to 0.4 (most preferably about 0.33) times the width of the side walls.

One of the further advantages of the carrying handle (as shown in FIG. 3) is that it affords an attractive extra surface for advertising, promotional material, and/or eye-catching package artwork. The punched-out blank from the griphole 9 and/or the griphole flap 10 may be used for proof-of-purchase coupons, or the like. Of course, when the box is small enough, it may be displayed by hanging it from pegs or rods inserted through the griphole, or in a similar manner.

It should be obvious that the strength (primarily tensile) of the material from which the box is made is partially determinative of the size and filled weight of the box that can safely be carried using the integral handle. Any suitable natural or synthetic material can be used, and paperboard or cardboard in which the fibers run in a generally up-and-down direction is preferred bacause of its increased tensile strength.

A particular advantage of all embodiments of this invention is that the shortened lower back wall flap 4b is punched out from that piece of carton material which, in conventional box blanks, is taken up solely by flaps the same length as flaps 1b, 2b, 3b. This results, in a conventionally designed carton blank, in a large waste of material between adjacent blanks.

Depending upon the dimensions of the assembled box, handle segments 4a' and 4a'' may be expanded in height to afford a larger assembled handle. This is particularly true when the depth of the assembled box (i.e. the width of side walls 1, 3) is increased, since this will necessarily result in an increase in length of at least flaps 2a, 2b and therefore provide minimum material wastage.

Although, in the embodiment of FIGS. 1 to 3, the divided top and bottom surfaces of the assembled box detract from its graphic appearance, this solution—considering the desirability of the material savings and the easy manner in which the box may be opened—is commercially attractive.

It also should be noted that the boxes of this invention are designed to be powder-tight after assembly, which is normally a very desirable property.

FIGS. 4 to 6 illustrate two further embodiments of this invention, which may be used independently or in conjunction.

In FIGS. 4 and 5, relief embossings 12 are located on flaps 1a, 1b, 3a, 3b. These embossings are characterized by having at least one defined edge, illustrated by V-shaped lines. When the box is assembled, the defined edges of the embossings 12 bias with stops which are correspondingly shaped cutouts 13, two of which are located on the lower edge of flap 4b and two of which on the upper edge of handle segment 4a'''. The use of similar embossings and complementary cutouts has been described in German patent application No. 28 45 720 published Apr. 30, 1980 and having the same inventor as the present invention. It may be noted, however, that the preferred embossings 12 of the present invention have only a protruding (male) leading edge. The combination of embossings 12 and interlocking cutouts 13 helps to afford powder-tight gluing. Thus, in assembling the embodiment of FIG. 4, and as partially shown in FIGS. 5 and 6, the side flaps 1a, 1b, 3a, 3b containing embossings 12 are folded first, followed by the handle flap 4a and lower back wall flap 4b containing the cutouts 13. While the foregoing are held in place by the embossing/cutout interaction and by gluing, lower front wall flap 2b is folded to afford an undivided bottom surface and upper front wall flap 2a is folded to afford an undivided top surface. It is also most desirable for the embossings and cutouts to interlock on the same level. This may be accomplished by slanting the folds 15 between the side walls and their upper and lower flaps, that is, those flaps which have been embossed. The pitch of the slants should preferably be about the thickness of the box material itself, over the entire length of each fold 15. The resulting box, shown in FIG. 6, does not have an integral opening means, but does provide a particularly powder-tight container with an integral carrying handle and attractive top and bottom surfaces. In fact, the effect in the sealing zone 15 is so optimal that even in cases of heavily staggered flap gluing, no channeling can occur, nor is it possible for the lower back wall flap 4b and the relief embossing 12 to overlap.

To ensure continuity of production during packaging, it is of advantage for the side flaps 1b, 3b at the bottom of the box to show the configuration of the unshortened flaps 2a, 2b so that, in the assembled state, they are able to carry the box blank in the machine layer-on. To ensure that the side flaps can always be folded in without interruption, the flaps should be slanted when they adjoin the unshortened flaps 2a, 2b.

In addition, it is of advantage in the case of jet gluing to minimize the cutout segments 13 in such a way that, on the front of the outer segment 4a''' and flap 4b, the outer edge of the cutouts 13 is just touched by the outer glue jet. At the same time, a jet of glue is directed onto the front of the unshortened flaps 2a, 2b in such a way that, after gluing, it touches the outer edge of the shortened flap 4b which is glued next.

Figure 8:
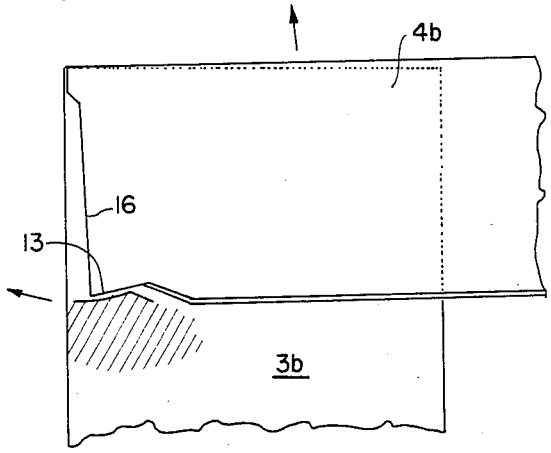
Figure 9:
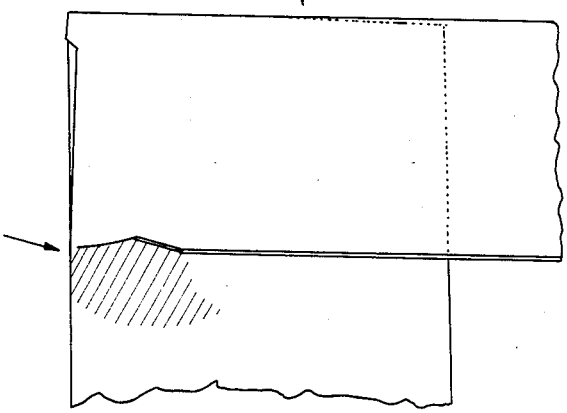

FIGS. 7 to 9 show optimized sealing details which always guarantee a powder-tight box, even in cases of heavily staggered flap gluing. FIG. 7 shows normal flap gluing while FIGS. 8 and 9 show heavily staggered flap gluing.

In another embodiment of the box blank shown in FIG. 10, the flaps 2b, 4b at the bottom of the parcel are shortened to approximately two thirds of their depth while the upper front wall flap 2a (at the top of the assembled box) remains unshortened, as in the embodiment shown in FIG. 1 or FIG. 4. In this case, material is also saved by two-in-one blanks, as illustrated. Once again, the assembled folding box may be sealed by the relief embossings 12 and corresponding cutouts 13, cf. FIGS. 5 and 6. A folding box assembled from a blank such as this would have an undivided top surface, but a laterally divided bottom surface.

Figure 12:
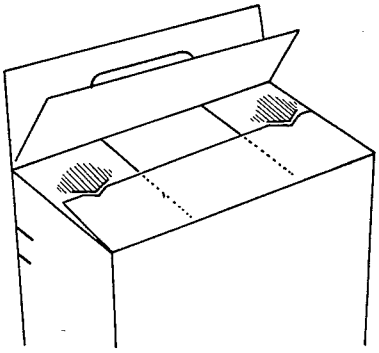
FIGS. 12 and 13 show boxes assembled from the blank according to FIG. 11 in successive production phases.
Figure 13:
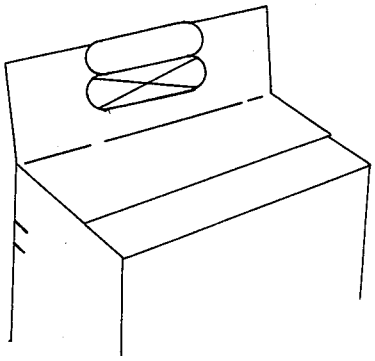

Finally, it is possible as shown in FIGS. 11 to 13 uniformly to shorten the upper front wall flap 2a, the outer segment 4a''' hinged to the carrying handle flap 4a, the lower front wall flap 2b and the lower back wall flap 4b to approximately two thirds of the depth of the assembled box. As illustrated, blanks such as these with the sealing details 13 and 14 may be economically produced in the form of double (multiple) blanks and assembled as illustrated in FIGS. 12 and 13. Boxes formed in this way have laterally divided top and bottom surfaces.

A remarkable difference between the blanks shown in FIGS. 4 and 10 on the one hand and in FIG. 11 on the other hand lies in the fact that the handle outer segment 4*a*''' no longer has to be short, in the same way as a gluing strip, but instead may have the same top to bottom length as the other flaps.

In a further embodiment, shown particularly in FIGS. 4, 7, 8, and 9, the handle outer segment 4*a*''' may have upper recesses 17 on each of its vertical edges and the lower back wall flap 46 may have similar lower recesses 16 on each of its vertical edges. These recesses permit a greater tolerance in the folding and assembly of the boxes. For example, as shown in FIG. 7 (top of the box), FIG. 8 (bottom of the box), and FIG. 9, the biasing of the cutouts and embossings may be staggered and yet the vertical edges of the cutout flap will not overhang the side walls of the assembled box. This presents a far more attractive appearance.

I claim:

1. A folding box blank comprising a narrow rectangular first side wall, with an upper first side flap separated therefrom by a fold line and a lower first side flap separated therefrom by a fold line;

a rectangular front wall of the same height as said first side wall and separated from said first side wall by a fold line, with an upper front wall flap separated therefrom by a fold line and a lower front wall flap separated therefrom by a fold line;

a narrow rectangular second side wall of substantially the same dimensions as said first side wall and separated from said front wall by a fold line, with an upper second side flap separated therefrom by a fold line and a lower second side flap separated therefrom by a fold line;

a rectangular back wall of substantially the same dimensions as said front wall and separated from said second side wall by a fold line, with an upper integral carrying handle flap separated therefrom by a fold line and a lower back wall flap separated therefrom by a fold line; and a gluing strip of substantially the same height as said walls and separated from said back wall by a fold line, with a short upper gluing strip flap separated therefrom by a fold line and a short lower gluing strip flap separated therefrom by a fold line;

wherein: said carrying handle flap itself comprises three parallel segments which are a handle inner segment separated from said back wall by a fold line, having a centrally positioned griphole means, the height of said segment being about 0.4 to 0.8 times the width of said side walls and the width being equal to the width of said back wall, a handle middle segment separated from said handle inner segment by a fold line, having centrally positioned griphole means, the height of said segment being substantially identical to that of said inner handle segment and the width being equal to the width of said back wall, and a handle outer segment demarked from said handle inner segment by a reverse fold line, the height of said segment being about 0.25 to 0.4 times the width of said side walls and the width less than that of said back wall;

and wherein further:

each of said four side wall flaps has a relief embossing which affords a raised portion on its outer surface when the box is assembled; and a pair of complementary shaped cutouts are on the top edge of one of the remaining upper flaps other than the glue strip flap and a pair of complementary shaped cutouts are on the bottom edge of one of the remaining lower flaps other than the glue strip flap; so that when said box is assembled, the cutouts interact with the embossings by biasing against them.

2. The folding box blank of claim 1 wherein said griphole means are: a flap in said handle inner segment formed by cutting through a major portion of a hole and forming a fold line for the remaining circumference; and a completely cut hole of corresponding configuration, size, and placement, in said handle middle segment.

3. The folding box blank of claim 1 wherein the sum of the total height of said upper front wall flap and said lower front wall flap is equal to the sum of the total height of said integral carrying handle flap and said lower back wall flap.

4. The folding box blank of claim 1 wherein said cutouts are on said handle outer segment and said lower back wall flap.

5. The folding box blank of claim 4 wherein: said upper and lower front wall flaps each have a height about equal to the width of said side walls, so that said box when assembled will have undivided top and bottom surfaces; and wherein said handle outer segment and said back wall lower flap have a height of about 0.25 to 0.4 times the width of said side walls.

6. The folding box blank of claim 5 wherein said handle outer segment and said back wall lower flap have a height of about 0.33 times the width of said side walls.

7. The folding box blank of claim 4 wherein: both lateral edges of said handle outer segment and both lateral edges of said lower back wall flap have vertical recesses running along a major portion of their respective lengths; the heights of said lower first side flap, lower front wall flap, lower second side flap, and upper front wall flap, are each approximately equal to the width of said side walls; and wherein the heights of said upper first side flap and upper second side flap are the same and are less than the width of said side walls.

8. The folding box blank of claim 1 wherein said cutouts are on said handle outer segment and said lower front wall flap.

9. The folding box blank of claim 8 wherein: said lower front wall flap and said lower back wall flap are of an equal height which is less than the width of said side walls, so that the bottom surface of said box when assembled is linearly divided; said lower side flaps are of an equal height which is less than that of said lower front wall flap; said handle outer segment height is less than that of said handle middle segment; said upper front wall flap is of a height slightly less than the width of said side wall so that when said box is assembled its top edge abuts the handle formed by the handle inner and middle segments and presents an undivided top surface; and said upper side flaps are somewhat less in height than said upper front wall flap.

10. The folding box blank of claim 9 wherein the heights of said lower front and back wall flaps is about 0.5 to 0.8 times the width of said side walls and the height of said handle outer segment is about 0.5 to 0.2 times the width of said side walls.

11. The folding box blank of claim 10 wherein the heights of said lower front and back wall flaps is about 0.67 times the width of said side walls, and the height of said handle outer segment is about 0.33 times the width of said side walls.

12. The folding box blank of claim 1 wherein said cutouts are on said upper front wall flap and said lower front wall flap.

13. The folding box blank of claim 12 wherein: said lower front wall flap and said lower back wall flap are of an equal height which is less than the width of said side walls, so that the bottom surface of said box when assembled is linearly divided; said lower side flaps are of equal height which is less than that of said lower front wall flap said handle outer segment height is approximately equal to or slightly less than that of said handle middle segment; said upper front wall flap is of a height approximately equal to the height of said handle middle segment, so that when said box is assembled its top surface is linearly divided; and said upper side flaps are somewhat less in height than said upper front wall flap.

14. The folding box blank of claim 13 wherein said upper and lower front wall flaps, said lower back wall flap, and each segment of said handle flap are all the same height which is equal to about 0.5 to 0.8 times the width of said side walls.

15. The folding box blank of claim 14 wherein all of said same height flaps have a height equal to about 0.67 times the width of said side walls.

16. The folding box blank of claim 1 wherein the folds between the side walls and their respective flaps are slanted from one end to the other at a pitch of about the thickness of the box blank material, so that the interaction of said embossings and said cutouts is facilitated.

17. The folding box blank of claim 1, incompletely severed from at least one identical box blank in a top to bottom arrangement.

18. The folding box blank of claim 1, incompletely severed from at least one identical box blank in a top to top arrangement.

* * * * *